US006571963B2

(12) United States Patent
Humphrey et al.

(10) Patent No.: US 6,571,963 B2
(45) Date of Patent: Jun. 3, 2003

(54) SWITCH HEATER COVER SUPPORT RACK

(76) Inventors: John Humphrey, 712 North St., Walnut, IA (US) 51577; Dean Wieser, 807 Hickory St., Atlantic, IA (US) 50022

( * ) Notice: Subject to any disclaimer, the term of this patent is extended or adjusted under 35 U.S.C. 154(b) by 0 days.

(21) Appl. No.: 10/039,828

(22) Filed: Oct. 19, 2001

(65) Prior Publication Data

US 2002/0060195 A1 May 23, 2002

Related U.S. Application Data

(60) Provisional application No. 60/241,570, filed on Oct. 19, 2000.

(51) Int. Cl.[7] ..... A47F 5/00
(52) U.S. Cl. ..... 211/13.1; 211/193; 211/4
(58) Field of Search ..... 211/193, 13.1, 211/4, 60.1; 70/58, 62

(56) References Cited

U.S. PATENT DOCUMENTS 2,765,646 A * 10/1956 Hepler
3,747,777 A * 7/1973 Kane
3,893,568 A * 7/1975 Lile
4,139,100 A * 2/1979 Reed ..... 211/4
4,426,011 A * 1/1984 Jay ..... 211/193
4,447,029 A * 5/1984 Chapman ..... 211/193 X
4,671,475 A * 6/1987 Widmer
5,018,690 A * 5/1991 Widmer
5,282,539 A * 2/1994 Saathoff ..... 211/4 X
5,520,291 A * 5/1996 Graham ..... 211/4
5,875,905 A * 3/1999 Gretencord ..... 211/193
6,129,224 A * 10/2000 Mingers ..... 211/193

* cited by examiner

*Primary Examiner*—Robert W. Gibson, Jr.
(74) *Attorney, Agent, or Firm*—Adam H. Jacobs

(57) ABSTRACT

A switch heater cover support rack includes at least one upwardly extending upright support unit including a ground-engaging base section, at least two generally horizontal cover support arms mounted on and extending generally perpendicular to the upwardly extending upright support unit and a locking device for releasably securing switch covers on the generally horizontal cover support arms.

7 Claims, 3 Drawing Sheets

SWITCH HEATER COVER SUPPORT RACK

CROSS-REFERENCE TO RELATED APPLICATION

This application claims priority to the filing date of a related provisional application Ser. No. 60/241,570 filed Oct. 19, 2000.

BACKGROUND OF THE INVENTION

1. Technical Field

The present invention relates to support structures for various types of covers and, more particularly, to a switch cover support rack including at least one upwardly extending upright support unit including a ground-engaging base section, at least two generally horizontal cover support arms mounted on and extending generally perpendicular to the upwardly extending upright support unit and a locking device for releasably securing switch covers on the generally horizontal cover support arms.

2. Description of the Prior Art

There are hundreds of thousands of railroad switches across the United States and throughout the world, and a significant percentage of these switches are found in areas which receive climactic extremes, including temperature and precipitation ranges which test the very limits of the switch equipment. Several types of protective devices are used in connection with the switches, for example, it is common to find heating systems used in connection with switches found in railroad track areas exposed to the cold, wind, or other such environmental occurrences, which could degrade the functionality of the switch. To combat this, heating devices are used which supply warm air to the switch mechanism, thereby preventing the switch from freezing and preventing malfunctioning of the switch apparatus. To keep the heat within and around the switch, switch covers, generally manufactured of fiberglass, are used which are mounted over the switching device. Of course, it is often not necessary for the switch device to be covered and protected, particularly during the summer months when freezing of the switch is an impossibility. During this time, the switch covers are removed from the top of the switching mechanism and placed to the side thereof. Of course, this often results in the switch covers being lost in weeds near the tracks, and occasionally being run over by equipment, thus requiring the purchase and installation of new switch covers. There is therefore a need for a support rack which will not only eliminate the damage or loss of the switch heater covers, but also extend their longevity by supporting them above the ground surface thus reducing rust, corrosion, dry rot and other such damage.

Another problem encountered with the switch covers is that they are often taken or stolen by vandals or thieves, thus mandating their replacement. Others are taken by the homeless to use as shelters, also requiring the replacement of the covers. However, regardless of the way in which the covers are taken, the fact remains that the covers must be replaced, which results in a significant expenditure of time, effort and money by the railroad companies. There is therefore a need for a switch heater cover support rack which will also prevent the theft of the switch heater covers, in addition to preventing damage to the switch covers.

Therefore, an object of the present invention is to provide a switch heater cover support rack.

Another object of the present invention is to provide a switch heater cover support rack which includes at least one upwardly extending upright support unit including a ground-engaging base section, at least two generally horizontal cover support arms mounted on and extending generally perpendicular to the upright support unit and a locking device for releasably securing switch covers on the generally horizontal cover support arms.

Another object of the present invention is to provide a switch heater cover support rack which will support the switch heater covers above the ground surface in an easily accessible position which generally prevents damage to the covers.

Another object of the present invention is to provide a switch heater cover support rack which will support the switch heater covers above the ground surface in a position in which the switch heater covers may be quickly and easily located without requiring searching and potential replacement of the switch heater covers.

Another object of the present invention is to provide a switch heater cover support rack which will prevent unauthorized removal or theft of the switch heater covers supported thereon.

Finally, an object of the present invention is to provide a switch heater cover support rack which is safe, durable and efficient in use.

SUMMARY OF THE INVENTION

The present invention provides a switch heater cover support rack which includes at least one upwardly extending upright support unit including a ground-engaging base section which is adapted for securely mounting the upright support unit in the ground, at least two generally horizontal cover support arms mounted on and extending generally perpendicular to the upright support unit and a locking device for releasably securing switch covers on the generally horizontal cover support arms thereby preventing unauthorized removal of the switch heater covers from the support rack.

It is clear that the features of this invention combine to form an easily used and extremely durable and efficient switch heater cover support rack. The rack supports the switch heater covers over and above the adjacent ground surface, thereby generally preventing the rust, corrosion, dry rot and other such damage caused to switch heater covers when they are left unprotected on the ground. Furthermore, the switch heater covers being mounted on the switch heater cover support rack will prevent unauthorized access to the switch heater covers, thus greatly reducing the number of covers which need to be replaced due to theft or the like. Finally, the present invention provides protection for the switch heater covers from the elements due to the stacking of the switch heater covers on the rack. It is thus seen that the present invention provides a substantial improvement over the prior art.

DESCRIPTION OF THE PREFERRED EMBODIMENT

Figure 1:
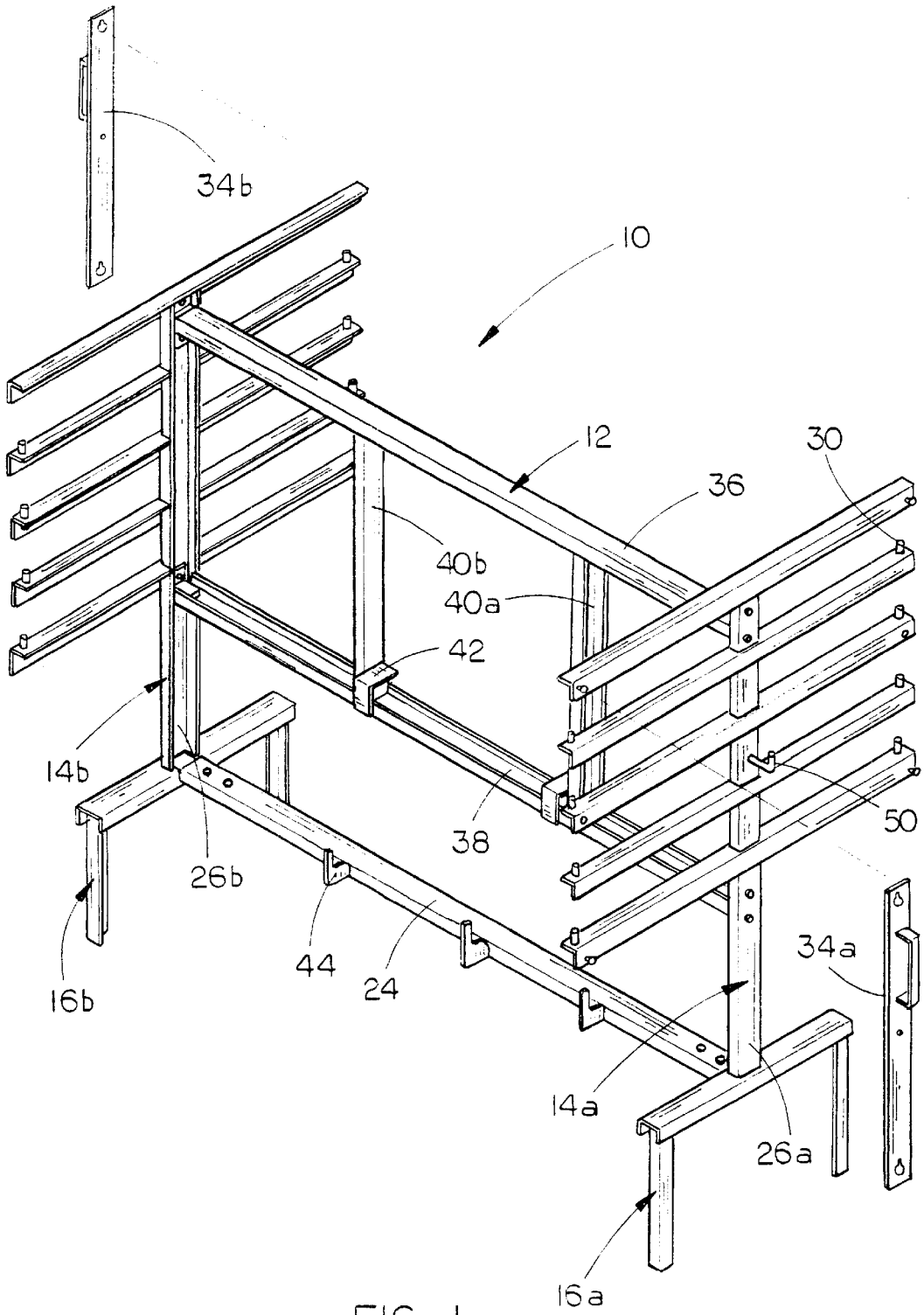
FIG. 1 is a perspective view of the switch cover support rack of the present invention.
Figure 2:
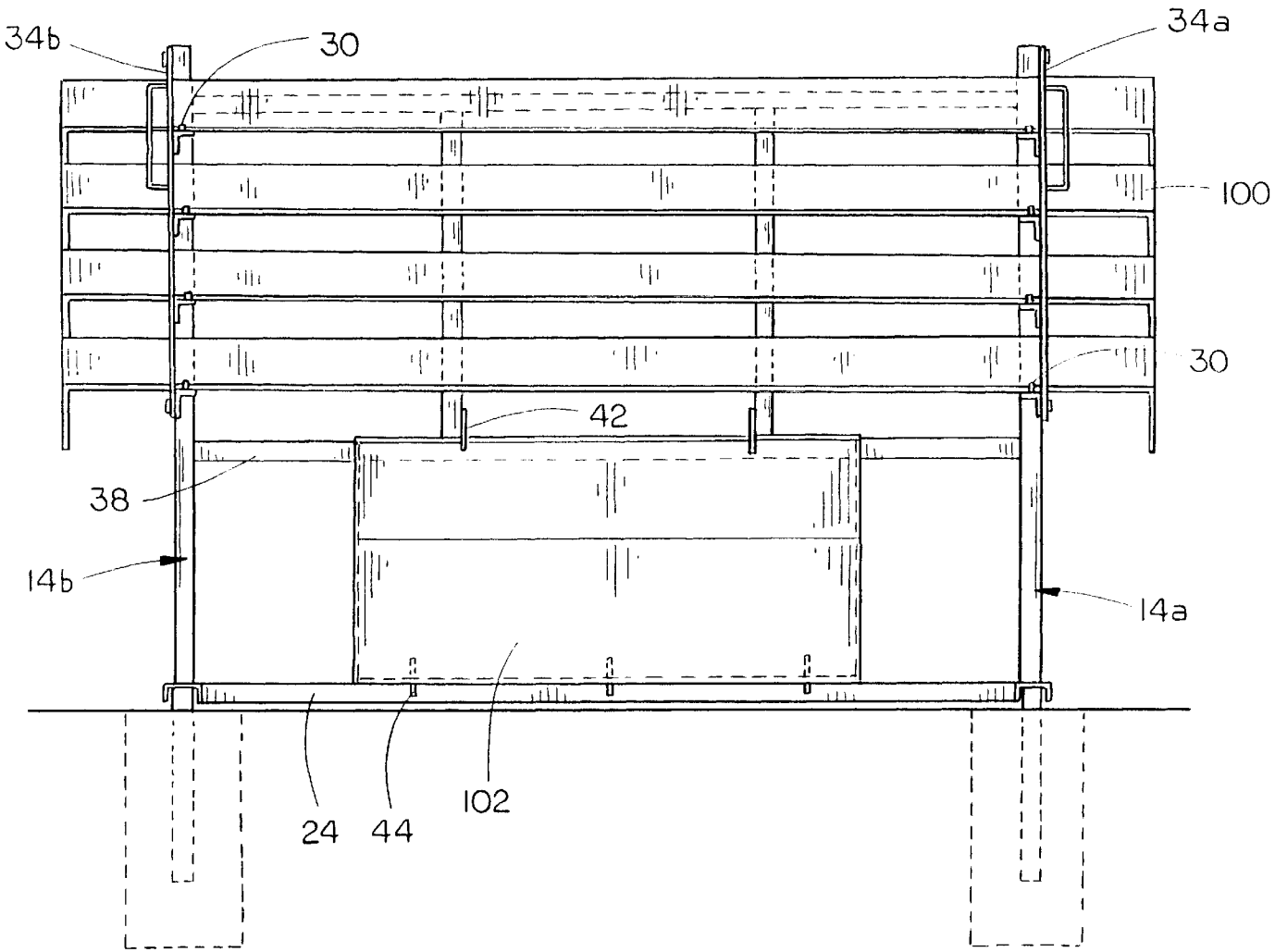
FIG. 2 is a side elevational view of the present invention showing switch covers supported thereon.
Figure 3:
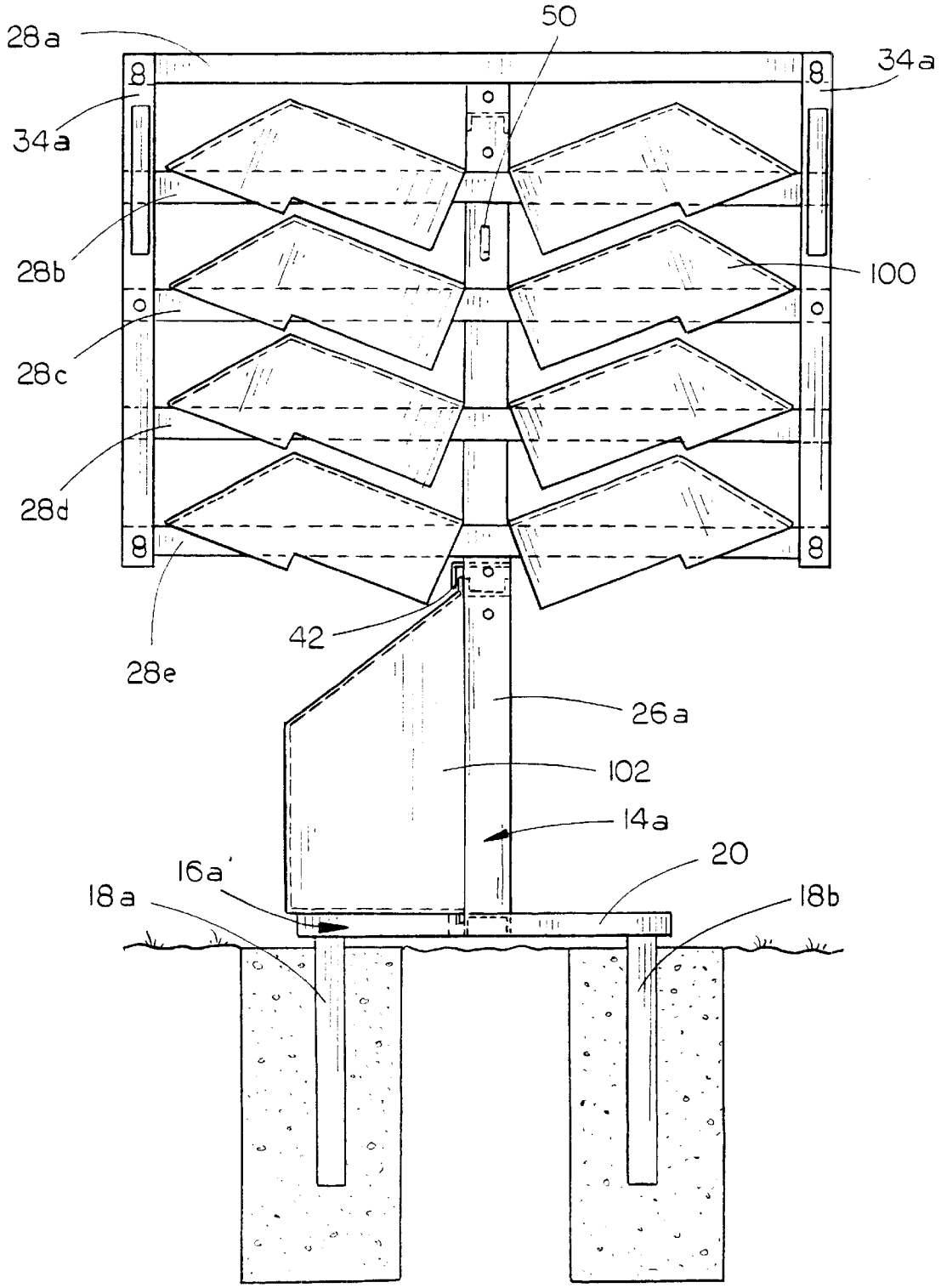
FIG. 3 is an end elevational view showing the elements of the present invention.

The switch cover support rack 10 of the present invention is best shown in FIGS. 1–3 as including a rack structure 12 having right and left upright support units 14*a* and 14*b*, each of which have a height of approximately 72 inches and are preferably constructed of heavy-duty C-channel for structural rigidity. As the structural characteristics of left and right upright support units 14*a* and 14*b* and the elements connected to them are generally identical, the following description, while pertaining to upright support units 14*a*, should also be understood to apply equally to upright support unit 14*b* in all respects thereto.

In the preferred embodiment, upright support units 14*a* and 14*b* would each include upside-down, generally U-shaped ground mounts 16*a* and 16*b* and a vertical support beam 26*a* and 26*b*, as shown best in FIGS. 1 and 3. As ground mounts 16*a* and 16*b* are identical to one another, the following description of ground mount 16*a* should be understood to apply equally to ground mount 16*b*. Ground mount 16*a* would preferably include downwardly extending ground-engaging struts 18*a* and 18*b* connected across the upper ends thereof by base support strut 20, as shown best in FIG. 3. In the preferred embodiment, ground-engaging struts 18*a* and 18*b* will be mounted in the ground within a pair of holes dug for the purpose of securing the struts 18*a* and 18*b* therewithin, and the holes may be filled with dirt, concrete, or any other fill material which will secure the rack structure 12 in position, as shown in FIG. 2. Extending between and connecting ground mounts 16*a* and 16*b* is at least one cross brace 24 which provides additional structural stability for rack structure 12.

During installation of the rack structure 12, it is preferred that the rack structure 12 be leveled to properly support and prevent accidental dislodging of covers supported thereon. The installer would thus level both the base support strut 20 and the cross brace 24 to provide both longitudinal and transverse leveling of the rack structure 12 thus properly installing the rack structure 12. Once the ground mounts 16*a* and 16*b* are secured in the ground, the rack structure 12 is prepared for supporting covers thereon, with the specific mounting of the covers being described herein below.

As was stated previously, the structural characteristics of left and right upright support units 14*a* and 14*b* and the elements connected to them are generally identical, so the following description, while pertaining to upright support units 14*a*, should also be understood to apply equally to upright support unit 14*b* in all respects thereto. Right upright support unit 14*a* includes vertical support beam 26*a* and mounted on and extending perpendicularly from vertical support beam 26*a* are a plurality of support arms 28*a*, 28*b*, 28*c*, 28*d* and 28*e*, with support arm 28*a* mounted atop vertical support beam 26*a* and each of the remaining support arms 28*b*, 28*c*, 28*d*, and 28*e* spaced downwards from support arm 28*a* substantially equidistantly as shown best in FIG. 3. In the preferred embodiment, each of the support arms 28*a–e* would be constructed of angle iron with the horizontal leg thereof extending in a plane generally perpendicular to the longitudinal axis of vertical support beam 26*a* and the vertical leg of each support arm 28*a–e* extending in a plane generally parallel with vertical support beam 26*a*. Each of these support arms 28*a–e* would preferably have a length of approximately 36 inches to 60 inches such that a switch cover may be supported on either side of vertical support beam 26*a*, as shown in FIG. 2. To provide additional securement for a switch cover 100 supported on the support arms 28*a–e,* a plurality of upwardly extending tabs 30 are mounted on opposite ends on each of the support arms 28*a–e*, as shown in FIG. 2, thereby preventing accidental dislodging of the switch cover 100 supported thereon. It should be noted that the upwardly extending tabs 30 have a functional requirement as stated above, but may be of varying sizes, shapes and construction materials, such as of rivets, angle iron sections or other such appropriate designs, depending on the size and shape of the covers to be supported on the rack 10.

Finally, to prevent theft of the switch cover 100 supported on the support rack 10, each end of the rack structure 12 includes two removably mounted locking bars 34*a* and 34*b*, which are removably mounted on the side of the support arms 28*a–e* between the uppermost and lowermost support arms 28*a* and 28*e*. As shown in FIG. 3, the locking bars 34*a* on the right side of the rack structure 12 are labeled identically, and the locking bars 34*b* on the left side of the rack structure 12 are likewise labeled identically. In the preferred embodiment, each of the locking bars 34*a* and 34*b* would include keyhole slots or the like which will engage pins located on the support arms 28*a* and 28*e*, the locking bars 34*a* and 34*b* then being locked in place preventing unauthorized removal of switch covers placed thereon. Once the switch cover 100 is placed on the support arm 28*c,* locking bar 34*a* is placed on the pins on the support arms 28*a* and 28*e* contacting the outer edges of each of the support arms 28*a–e* and is then locked in place by a padlock or the like thus preventing unauthorized opening of locking bar 34*a*. It can be seen that due to the shape of switch cover 100, it is impossible to remove the switch cover 100 from the end of support rack 10, and that the switch cover 100 must therefore be removed from the side of support rack 10. As the locking bar 34*a* prevents the unauthorized side removal of switch cover 100, switch cover 100 is safely secured on support rack 10 in a manner to prevent theft or the like. It is thus seen that the locking bars 34*a* and 34*b* of the present invention function to restrict unauthorized access to switch cover 100 and therefore accomplish their intended purpose. For storage purposes, the present invention may also include one or more storage hooks 50 on which the locking bars 34*a* and 34*b* can be placed during the placing of switch covers on the rack.

Finally, FIGS. 1 and 2 disclose the stabilizing features of upright support units 14*a* and 14*b*, which, in the preferred embodiment, include upper and lower horizontal brace struts 36 and 38 which extend between and are connected to vertical support beams 26*a* and 26*b* at the upper section and middle section respectively thereof. Also, brace bars 40*a* and 40*b* extend between upper and lower horizontal brace struts 36 and 38, as shown best in FIGS. 1 and 2, to provide additional structural stability to the rack structure 12. The switch cover support rack 10 of the present invention would preferably be assembled as an entire unit and then would be placed in the ground as was described previously, although the precise method of installation and assembly is not critical to the present invention so long as the functional characteristics of the invention are maintained. It is preferred that the entire unit be interconnected by bolts, nuts, screws or the like, as shown in FIGS. 1 and 3, although again the precise fastener type used is not critical to the invention.

FIGS. 1 and 2 also disclose how a different type of switch cover 102 would be releasably supported on the switch cover support rack 10 of the present invention. Lower brace strut 38 would further include at least one clip or bracket 42, which is designed to function in combination with cover support mounts 44 mounted on cross brace 24. In the preferred embodiment, switch cover 102 would be inserted first into the clip or bracket 42 and then moved downwards to engage cover support mounts 44, as shown in FIGS. 1 and 2. The clip or bracket 42 work in combination with the cover support mounts 44 to secure the switch cover 102 on the rack

10, and when a first type of switch cover 100 is placed on the cover support arm 28*e*, upward movement of the switch cover 102 is prevented, thus preventing release of the switch cover 102 from the clip or bracket 42 and the cover support mounts 44, and therefore switch cover 102 is releasably secured on switch cover support rack 10.

It is to be understood that numerous modifications, additions and substitutions may be made to the switch heater cover support rack 10 of the present invention. For example, the size, shape and dimensions of the switch cover support rack 10 may be modified or changed so long as the intended functional purpose of supporting the switch covers is maintained. Also, the construction materials used for the present invention may be modified or changed depending upon the design specifications mandated by the equipment being supported. Finally, the number of support arms and precise nature of the locking device may be modified and/or changed.

There has therefore been shown and described a switch cover support rack which accomplishes at least all of its intended purposes.

We claim:

1. A switch heater cover support rack comprising;

at least one upwardly extending upright support unit including a ground-engaging base section;

at least two generally horizontal cover support arms mounted on and extending generally perpendicular from said at least one upright support unit; and at least one removably mounted locking device removably mounted between at least two of said support arms, said at least one locking device being releasably locked thereon preventing unauthorized removal of switch covers placed on said switch heater cover support rack.

2. The switch heater cover support rack of claim 1 comprising two upright support units wherein said ground-engaging section comprises an upside-down, generally U-shaped ground mount, said upright support units further comprising a generally vertical support beam mounted on and extending upwards from said ground mount and at least one cross brace extending between and connecting said upright support units for supporting said upright support units in generally upright position.

3. The switch heater cover support rack of claim 2 wherein said at least two generally horizontal cover support arms are mounted on said generally vertical support beams, at least two generally horizontal cover support arms mounted on each of said generally vertical support beams.

4. The switch heater cover support rack of claim 1 wherein said at least one locking device comprises at least one removably mounted locking bar removably mounted between two of said support arms, said at least one locking bar being releasably locked thereon preventing unauthorized removal of switch covers placed on said switch heater cover support rack.

5. The switch heater cover support rack of claim 2 further comprising a lower brace strut extending between and connecting said two upright support units above said cross brace, at least one bracket mounted on said lower brace strut and at least one cover support mount mounted on said cross brace, said at least one bracket and said at least one cover support mount cooperating to releasably support a switch heater cover thereon.

6. A switch heater cover support rack comprising;

at least two upright support units each including a ground-engaging section and a generally vertical support beam mounted on and extending upwards from said ground-engaging section;

at least one cross brace extending between and connecting said at least two upright support units for supporting said at least two upright support units in generally upright position;

at least four generally horizontal cover support arms, at least two of said at least four generally horizontal cover support arms mounted on and extending generally perpendicular from each of said generally vertical support beams; and at least one removably mounted locking device removably mounted between at least two of said support arms, said at least one locking device being releasably locked thereon preventing unauthorized removal of switch covers placed on said switch heater cover support rack.

7. A switch heater cover support rack comprising;

at least one upwardly extending upright support unit including a ground-engaging base section;

at least two generally horizontal cover support arms having opposite ends and mounted on and extending generally perpendicular from said at least one upright support unit; and at least one locking device mounted on at least one of said at least one upright support unit and said plurality of generally horizontal cover support arms, said at least one locking device operative to releasably secure switch heater covers on said generally horizontal cover support arms; and each of said at least two generally horizontal cover support arms further including a plurality of upwardly extending tabs mounted on said opposite ends on each of said at least two generally horizontal cover support arms thereby preventing accidental dislodging of a switch cover supported thereon.

* * * * *